US007319760B2

(12) United States Patent
Sekine et al.

(10) Patent No.: US 7,319,760 B2
(45) Date of Patent: Jan. 15, 2008

(54) APPARATUS FOR CREATING SOUND IMAGE OF MOVING SOUND SOURCE

(75) Inventors: Satoshi Sekine, Hamamatsu (JP); Kiyoto Kuroiwa, Hamakita (JP)

(73) Assignee: Yamaha Corporation, Hamamatsu-shi (JP)

( * ) Notice: Subject to any disclaimer, the term of this patent is extended or adjusted under 35 U.S.C. 154(b) by 162 days.

(21) Appl. No.: 11/093,653

(22) Filed: Mar. 29, 2005

(65) Prior Publication Data

US 2005/0220308 A1 Oct. 6, 2005

(30) Foreign Application Priority Data

Mar. 31, 2004 (JP) ..... 2004-107458

(51) Int. Cl.
*H04R 5/00* (2006.01)
*H04R 29/00* (2006.01)

(52) U.S. Cl. ..... 381/17; 381/56

(58) Field of Classification Search ..... 381/1, 381/17, 18, 19, 22–23, 61, 80, 104, 107, 381/109; 352/27, 37; 463/35
See application file for complete search history.

(56) References Cited

U.S. PATENT DOCUMENTS 5,337,363 A * 8/1994 Platt ..... 381/17
5,440,639 A * 8/1995 Suzuki et al. ..... 381/17
5,596,645 A * 1/1997 Fujimori ..... 381/17
5,844,816 A * 12/1998 Inanaga et al. ..... 702/145
5,946,400 A * 8/1999 Matsuo ..... 381/17
6,574,339 B1 * 6/2003 Kim et al. ..... 381/17
6,683,959 B1 * 1/2004 Kuwano et al. ..... 381/17
6,760,050 B1 * 7/2004 Nakagawa ..... 715/848
7,027,600 B1 * 4/2006 Kaji et al. ..... 381/17
7,197,151 B1 * 3/2007 Sibbald et al. ..... 381/310
2004/0032955 A1 * 2/2004 Hashimoto et al. ..... 381/18
2006/0153396 A1 * 7/2006 John ..... 381/60

FOREIGN PATENT DOCUMENTS

JP 06-327100 11/1994

* cited by examiner

*Primary Examiner*—Vivian Chin
*Assistant Examiner*—Stephen C. Hung
(74) *Attorney, Agent, or Firm*—Morrison & Foerster LLP

(57) ABSTRACT

In a sound image creating apparatus, a distance computation section computes intermediate positions of a moving point along a trajectory line from a movement start position to a movement end position, and further computes a variable distance between each of the intermediate positions of the moving point and a fixed point. A velocity computation section computes a variable velocity of the moving point relative to the fixed point along the time axis on the basis of the variable distance. A signal processing section attenuates or delays an input sound signal in accordance with the variable distance, and varies a pitch of the input sound signal on the basis of the variable velocity, thereby creating the sound image of the input sound signal along the time axis based on principle of Doppler effect.

4 Claims, 4 Drawing Sheets

APPARATUS FOR CREATING SOUND IMAGE OF MOVING SOUND SOURCE

BACKGROUND OF THE INVENTION

1. Technical Field

The present invention relates to a technology for realizing the sound image movement accompanying the Doppler effect.

2. Related Art

A technique is known in which music sound signals on the left and right signal lines are delayed in time and adjusted in amplitude to cause a time delay and an amplitude difference between the left and right signal lines, thereby auditorily providing a sense of direction and distance perspective to music sounds to create a sense of sound image panning.

Meanwhile, if a sound source and a listener listening to a music sound generated from the sound source are moving relative to each other (for example, a sound source is moving at a predetermined velocity while the listener is standing still), the Doppler effect occurs in accordance with the relative movement. However, if a sound image movement is expressed solely by the time difference and the amplitude difference between the left and right signal lines as described above, the Doppler effect cannot be represented realistically, thereby causing a problem of poor sound quality.

In order to solve this problem, a technique was proposed as disclosed in Japanese Publication of Unexamined Patent Application No. Hei 06-327100, for example. In the disclosed technique, the frequency of a sound signal outputted from a frequency-variable sound source is varied in accordance with a manner by which a sound image moves, and the sound signal generated from the frequency-variable sound source and separated into the left and right channels is outputted as delayed in accordance with that movement, thereby rendering the Doppler effect.

The synchronous reproduction of moving picture and music sound as with video games requires to make synchronization between the sound source movement represented in the moving picture and the sound image movement. For the technique disclosed in Japanese Publication of Unexamined Patent Application No. Hei 06-327100, in order to realize the sound image movement accompanying the Doppler effect, a condition and manner by which the sound source moves must be grasped by reproducing the above-mentioned moving picture on a frame by frame basis, and the frequency of the sound signal outputted from the above-mentioned frequency-variable sound source must be varied in accordance with the moving condition, thus requiring cumbersome tasks. Another problem is that, because the sound source moving condition must be visually checked, it is difficult to realize the sound image movement that correctly synchronizes with the sound source moving condition represented in the moving pictures.

SUMMARY OF THE INVENTION

It is therefore an object of the present invention to provide a technique for correctly and easily realizing a sound image movement accompanying the Doppler effect in accordance with a relative movement between sound source and listener.

In carrying out the invention and according to one aspect thereof, there is provided an apparatus for creating a sound image of an input sound signal in association with a moving point and a fixed point along a time axis, the sound image being associated with one of the moving point and the fixed point and the input sound signal being associated with the other of the moving point and the fixed point. The inventive apparatus comprises a setting section that sets input factors including a trajectory line which may be curved or straight and which represents a trajectory of the moving point, a nominal velocity of the moving point, a movement start time at which the moving point starts moving, a movement end time at which the moving point ends moving, and a closest approach time at which a distance between the moving point on the trajectory line and the fixed point is minimized, a position computation section that computes a closest approach position which is a position of the moving point on the trajectory line at the closest approach time, a movement start position which is a position of the moving point on the trajectory line at the movement start time, and a movement end position which is a position of the moving point on the trajectory line at the movement end time, on the basis of the input factors set by the setting section, a distance computation section that computes intermediate positions of the moving point along the trajectory line from the movement start position to the movement end position between the movement start time and the movement end time, and further computes a variable distance between each of the intermediate positions of the moving point and the fixed point, a velocity computation section that computes a variable velocity of the moving point relative to the fixed point along the time axis on the basis of the variable distance computed by the distance computation section, and a signal processing section that attenuates or delays the input sound signal in accordance with the variable distance computed by the distance computation section and that varies a pitch of the input sound signal on the basis of the variable velocity computed by the velocity computation section, thereby creating the sound image of the input sound signal along the time axis.

Preferably, the signal processing section computes a variation of the pitch of the input sound signal which is generated from one of the moving point and the fixed point and which is received by the other of the moving point and the fixed point, the apparatus further comprising a display section that displays the variation of the pitch of the input sound signal along the time axis.

Preferably, the setting section further sets an attenuation coefficient as one of the input factors, and the signal processing section determines an attenuation amount of the input sound signal in accordance with the variable distance, and further adjusts the attenuation amount in accordance with the attenuation coefficient.

In carrying out the invention and according to another aspect thereof, there is provided a program executable by a computer to perform a method of creating a sound image of an input sound signal in association with a moving point and a fixed point along a time axis, the sound image being associated with one of the moving point and the fixed point and the input sound signal being associated with the other of the moving point and the fixed point. The method comprises the steps of setting input factors including a trajectory line which may be curved or straight and which represents a trajectory of the moving point, a nominal velocity of the moving point, a movement start time at which the moving point starts moving, a movement end time at which the moving point ends moving, and a closest approach time at which a distance between the moving point on the trajectory line and the fixed point is minimized, computing a closest approach position which is a position of the moving point on the trajectory line at the closest approach time, a movement start position which is a position of the moving point on the trajectory line at the movement start time, and a movement end position which is a position of the moving point on the trajectory line at the movement end time, on the basis of the input factors, computing intermediate positions of the moving point along the trajectory line from the movement start position to the movement end position between the movement start time and the movement end time, and further computing a variable distance between each of the intermediate positions of the moving point and the fixed point, computing a variable velocity of the moving point relative to the fixed point along the time axis on the basis of the variable distance, and processing the input sound signal such as to attenuate or delay the input sound signal in accordance with the variable distance and to vary a pitch of the input sound signal on the basis of the variable velocity, thereby creating the sound image of the input sound signal along the time axis.

According to the sound image movement processing apparatus and program, by setting the curves or lines representative of a trajectory of a moving point, and its velocity, movement start time, movement end time, and closest approach time, the apparatus computes the closest approach position, movement start position, movement end position accordingly. Next, a variable distance between the moving point and the fixed point at intermediate times between the movement start time and the movement end time is computed. Further on the basis of the computed variable distance, a variable velocity of the moving point relative to the fixed point at times is computed. A sound signal inputted into the sound processing apparatus is attenuated or delayed in accordance with the variable distance and outputted with its pitch varied on the basis of the obtained variable velocity.

As described and according to the invention, a sound image movement accompanying the Doppler effect in accordance with a relative movement between sound source and listener can be correctly and easily realized.

DETAILED DESCRIPTION OF THE INVENTION

The following describes the best mode for carrying out the invention with reference to drawings.

Figure 1:
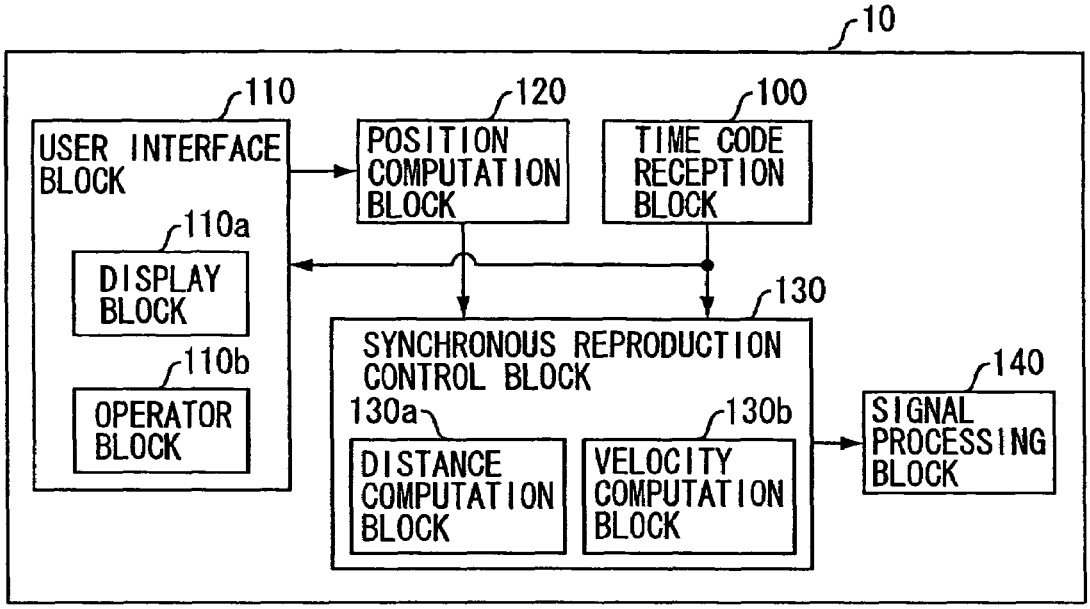
FIG. 1 is a block diagram illustrating an exemplary configuration of a sound image movement processing apparatus practiced as a first embodiment of the invention.

Referring to FIG. 1, there is shown a block diagram illustrating an exemplary configuration of a sound image movement processing apparatus 10 practiced as a first embodiment of the invention. As shown in FIG. 1, the sound image movement processing apparatus 10 has a time code reception block 100, a user interface block 110, a position computation block 120, a synchronous reproduction control block 130, and a signal processing block 140.

The time code reception block 100 is connected with a moving picture reproduction apparatus, not shown, from which the time codes allocated to the frames of a moving picture being reproduced by this moving picture reproduction apparatus are sequentially supplied therefrom to the time code reception block 100. The time code reception block 100 is adapted to pass the time codes received from this moving picture reproduction apparatus to the user interface block 110 and the synchronous reproduction control block 130. The details thereof will be described later. In the present embodiment, the time code is used as an intermediary for providing synchronization between the reproduction of moving picture by the above-mentioned moving picture reproduction apparatus and the sound image movement accompanying the Doppler effect that is executed by the sound image movement processing apparatus 10.

Figure 2:
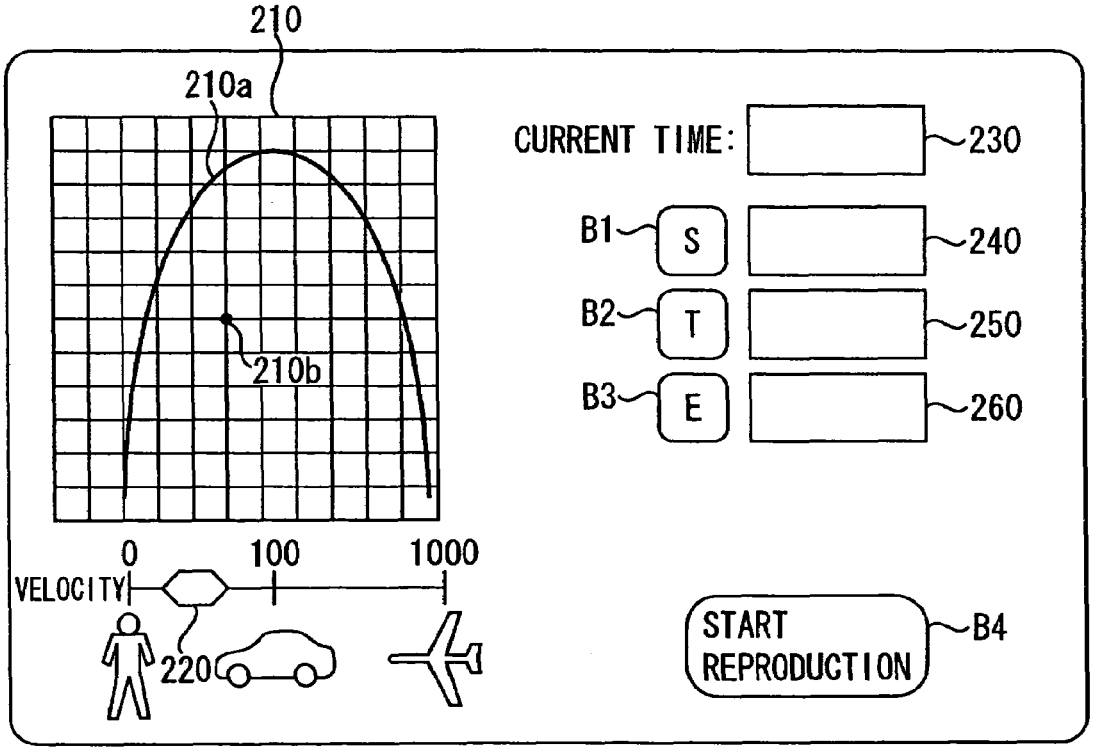
FIG. 2 is a schematic diagram illustrating an exemplary GUI screen that is presented on a display.

The user interface block 110 has a display block 110*a* and an operator block 110*b* as shown in FIG. 1, providing a user interface for allowing the user to use the sound image movement processing apparatus 10 by inputting parameters or input factors. To be more specific, the display block 110*a* is a liquid crystal display and its driver circuit for example. The operator block 110*b* is made up of a mouse and a keyboard for example. When the power supply (not shown) of the sound image movement processing apparatus 10 is turned on, a GUI (Graphical User Interface) as shown in FIG. 2 is displayed on the display block 110*a*. The following describes this GUI in detail.

An area 210 of the GUI screen shown in FIG. 2 is an input area for letting the user set the moving trajectory of a sound source (hereafter also referred to as a moving point) represented in the above-mentioned moving picture. To be more specific, the user interface block 110 stores parameters for uniquely identifying a parabola (for example, the parameters for identifying the coordinates of the inflexion point and the curvature of a parabola) and parameters for uniquely identifying a fixed point representative of the position of listener listening, in the standstill manner, to the sound radiated from the above-mentioned sound source. The area 210 shown in FIG. 2 displays a parabola 210*a* and a symbol 210*b* representative of the above-mentioned fixed point. The user can move the parabola 210*a* by clicking it with the mouse to change the coordinates of the reflection point or deform the parabola 210*a* to change the curvature thereof, thereby matching the parabola 210*a* with the trajectory of the sound source in the above-mentioned moving picture. When the operations for changing the reflection point and curvature of the parabola 210*a* have been done by the user, the user interface block 110 accordingly rewrites the above-mentioned parameters that identify the parabola 210*a*. Consequently, the trajectory of the above-mentioned moving point is set. It should be noted that, in the description of present embodiment made above, the parabola 210*a* displayed in the area 210 is deformed or moved by operating the mouse, setting the trajectory of the above-mentioned moving point; alternatively, the parameters for uniquely identifying the parabola corresponding to the above-mentioned trajectory may be numerically set. It should also be noted that, in the description of the present embodiment made above, a parabola is set as the trajectory of the above-mentioned moving point; alternatively, other curves or lines such as circle or ellipse may be set as the above-mentioned trajectory. It should be noted that, in the description of the present embodiment, an example in which the position of the above-mentioned fixed point is not change is used; alternatively, the above-mentioned fixed point may be changed by moving the symbol 210*b* by operating the mouse.

An indicator 220 on the GUI screen shown in FIG. 2 lets the user set the nominal velocity of the above-mentioned moving point with sonic velocity as the upper limit. To be more specific, the user can click the indicator 220 and drags it to the left or the right with the mouse to set the above-mentioned velocity. As shown in FIG. 2, the scale indicative of human walking velocity 0 k/h to several km/h is indicated by a symbol representative of human being, the scale indicative of automobile velocity 100 km/h is indicated by a symbol representative of car, and the scale indicative of airplane velocity 1000 k/m is indicated by a symbol representative of airplane. These symbols are used to let the user intuitively understand the above velocity ranges. Obviously, however, other symbols may be used for this purpose.

An area 230 shown in FIG. 2 sequentially displays time codes supplied from the time code reception block 100. Setting buttons B1, B2, and B3 shown in FIG. 2 are operated by the user to set the start time at which the above-mentioned moving point gets started (hereafter referred to as "movement start time"), the time at which the distance between the above-mentioned moving point and the above-mentioned fixed point is minimized (hereafter referred to as "closest approach time"), and the time at which the above-mentioned moving point stops moving (hereafter referred to as "movement end time"), respectively, on the basis of the time code displayed in the above-mentioned area 230. To be more specific, pressing the above-mentioned setting button B1 causes the user interface block 110 to set the time code displayed in the area 230 as the movement start time and display the set time in an area 240. Pressing the above-mentioned setting button B2 causes the user interface block 110 to set the time code displayed in the area 230 as the closest approach time and display the set time in an area 250. Pressing the above-mentioned setting button B3 causes the user interface block 110 to set the time code displayed in the area 230 as the movement end time and display the set time in an area 260. In the present embodiment, the time codes to be displayed in the area 230 are supplied from the above-mentioned moving picture reproduction apparatus. Therefore, setting the above-mentioned movement start time, closest approach time, and movement end time while making confirmation of the sound source moving condition by making the above-mentioned moving picture reproduction apparatus reproduce a moving picture representative of the sound source movement allows the setting of the movement start time, closest approach time, and movement end time in synchronization with the sound source moving condition represented by that moving picture. It should be noted that, in the description of the present embodiment made above, an example is used in which the movement start time, closest approach time, and movement end time are set by use of the time codes supplied from the outside of the sound image movement processing apparatus 10 (the above-mentioned moving image reproduction apparatus in the present embodiment); alternatively, these times may be inputted numerically.

As described above, visually checking the GUI screen shown in FIG. 2, the user can set various parameters such as those uniquely identifying a parabola representative of the above-mentioned moving point trajectory and those representative of the above-mentioned moving point velocity, movement start time, closest approach time, and movement end time. Namely, the user interface block 110 functions as the means for setting the above-mentioned various parameters. When a reproduction start button B4 on the GUI screen shown in FIG. 2 is pressed, the user interface block 110 passes the various parameters inputted by the user to the position computation block 120.

On the basis of the parameters received from the user interface block 110, the position computation block 120 computes a position at which the distance between the above-mentioned moving point and the above-mentioned fixed point is closest on the above-mentioned trajectory (hereafter referred to as a closest approach position), and at the same time, computes a movement start position at which the above-mentioned moving point is found at the above-mentioned movement start time and a movement end position at which the above-mentioned moving point is found at the above-mentioned movement end time, passing the obtained coordinates of these movement start position and movement end position to the synchronous reproduction control block 130. To be more specific, the position computation block 120 identifies, as the above-mentioned movement end position, a position obtained by moving the above-mentioned moving point from the above-mentioned closest approach position along the above-mentioned trajectory at the above-mentioned velocity in a predetermined direction (for example, the direction in which coordinate x always increases) by an amount of time corresponding to a difference between the above-mentioned movement end time and the above-mentioned closest approach time. In addition, the position computation block 120 identifies, as the above-mentioned movement start position, a position obtained by moving the above-mentioned moving point from the above-mentioned closest approach position along the above-mentioned trajectory at the above-mentioned velocity in the direction reverse to the above-mentioned predetermined direction by an amount of time corresponding to a difference between the above-mentioned movement start time and the above-mentioned closest approach time. It should be noted that, if there are two or more closest approach positions, the position computation block 120 is assumed to identify one that provides the smallest distance with the movement start position as the closest approach position.

The synchronous reproduction control block 130 includes a distance computation block 130*a* and a velocity computation block 130*b* as shown in FIG. 1. The distance computation block 130*a* computes the distance between the above-mentioned moving point and the above-mentioned fixed point in the time between the above-mentioned movement start time and the above-mentioned movement end time on the basis of the movement start position and movement end position coordinates received from the position computation block 120 and the parameters indicative of the above-mentioned trajectory and velocity received from the user interface block 110. In the present embodiment, the distance computation block 130*a* passes both of the computed distance in the time represented by the time code received from the time code reception block 100 and this time code to the velocity computation block 130*b* and passes the computed distance to the signal processing block 140.

On the basis of the time code and the computed distance (namely, the distance between the moving point and the fixed point at the time represented by that time code) received from the distance computation block 130*a*, the velocity computation block 130*b* computes a velocity of the above-mentioned moving point relative to the above-mentioned fixed point in the time represented by that time code and passes the computed velocity to the signal processing block 140. For example, let the above-mentioned distance at time t1 be L1 and a distance at time t1+Δt after unit time Δt be L2, then the velocity computation block 130*b* computes velocity Vs of the above-mentioned moving point relative to the above-mentioned fixed point at time t1 from equation (1) below and passes the computed velocity to the signal processing block 140. It should be noted that, in the present embodiment, above-mentioned Δt denotes a time interval between time codes.

$$Vs=(L2-L1)/\Delta t \quad (1)$$

The signal processing block 140 attenuates or delays the inputted sound signal for each channel in accordance with the distance received from the distance computation block 130*a* and varies the frequency fo (hereafter also referred to as a pitch) of each sound signal to frequency f to be computed from equation (2) below, outputting obtained frequency f. It should be noted that, in equation (2), V denotes sonic velocity and Vs denotes the velocity received from the speed computation block 130*b*.

$$f=fo\times V/(V-Vs) \quad (2)$$

Figure 3:
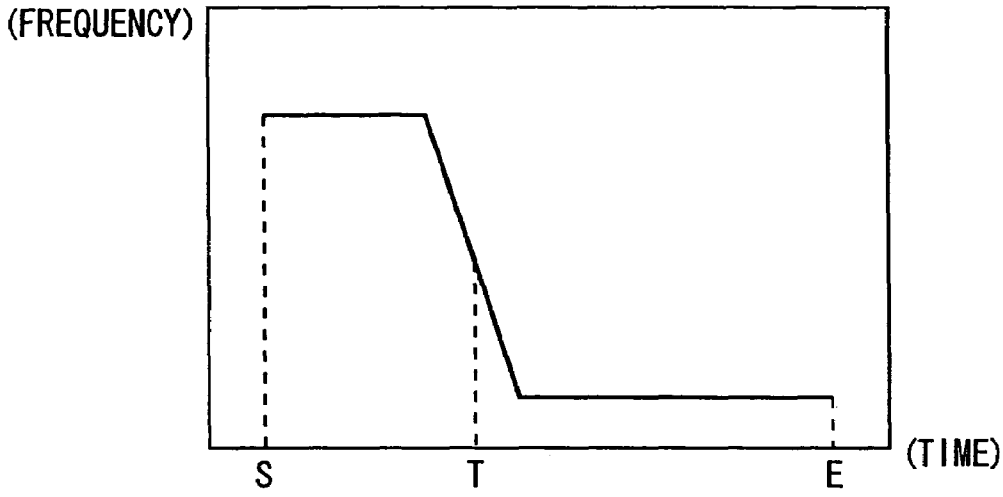
FIG. 3 is a graph indicative of a pitch variation of a sound signal outputted from a signal processing block.

Equation (2) above is a general expression of the Doppler effect. Namely, a sound signal outputted from the signal processing block 140 contains a frequency variation (hereafter also referred to as a pitch variation) due to the Doppler effect. FIG. 3 is a diagram illustrating the plotting, along the time axis, of the pitch variation of a sound signal outputted from the signal processing block 140. As shown in FIG. 3, the sound signal outputted from the signal processing block 140 quickly lowers in its pitch in the vicinity of the closet approach time. Hence, unless the parameters are set so as to make the moving point correctly pass the closest approach position at the closest approach time, the synchronization between the above-mentioned sound image movement by the sound signal and the sound source movement represented by the moving picture will be lost. As described above, in the conventional practice, the above-mentioned parameter setting is visually executed, thereby making it difficult to correctly synchronize the above-mentioned sound image movement by the sound signal with the sound source movement represented by the moving picture. In contrast, according to the present embodiment, setting only the moving point trajectory and the closest approach time allows the computation of the closest approach position on the basis of the relationship between the trajectory and the fixed point, thereby adjusting the movement start position and the movement end position such that the moving point passes the closest approach position at the closest approach time. Consequently, the novel configuration realizes an advantage in which the above-mentioned sound image movement by the sound signal is easily and correctly synchronized with the sound source movement represented by the moving picture.

The above-mentioned embodiment according to the invention may be varied as follows.

Variation 1:

With reference to the above-mentioned embodiment, if the listener who is standstill at a predetermined fixed point listens to a tone outputted from a moving point, the sound image movement accompanying the Doppler effect is realized in accordance with the relative movement of that moving point to the listener. It is also practicable to realize the sound image movement accompanying the Doppler effect with the above-mentioned moving point being the listener who listens to a tone outputted from the sound source that is standstill at the above-mentioned fixed point. To be more specific, this variation is achieved by converting frequency fo of a sound signal inputted in the signal processing block 140 into frequency f computed from equation (3) below and outputting the tone having this frequency f.

$$f=fo\times(V+Vs)/V \quad (3)$$

Figure 4:
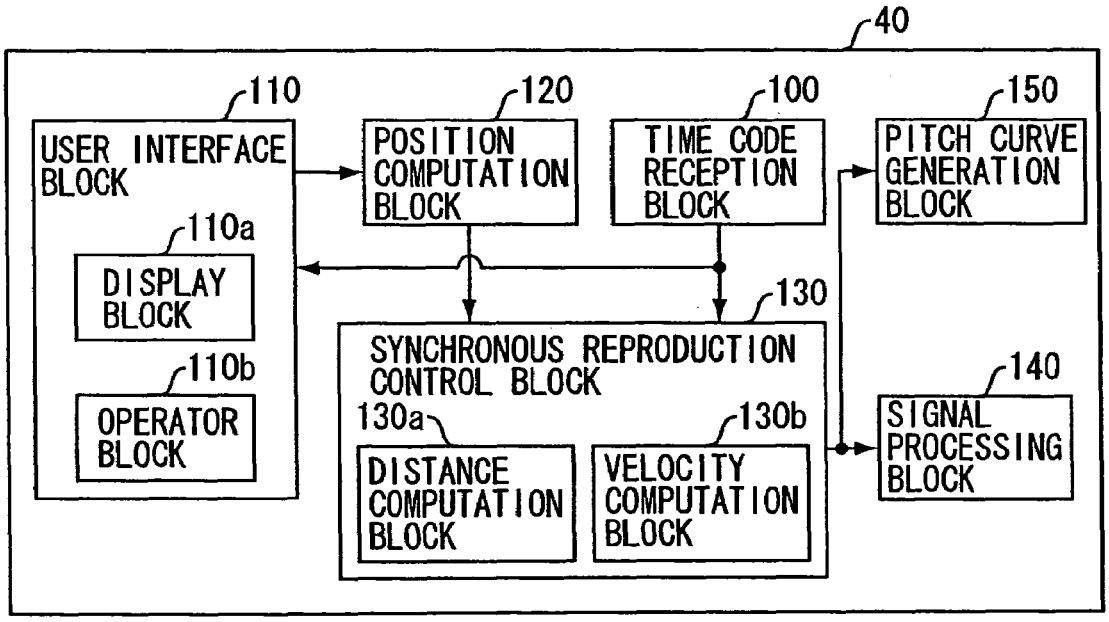
FIG. 4 is a block diagram illustrating an exemplary configuration of a sound image movement processing apparatus practiced as one variation.
Figure 5:
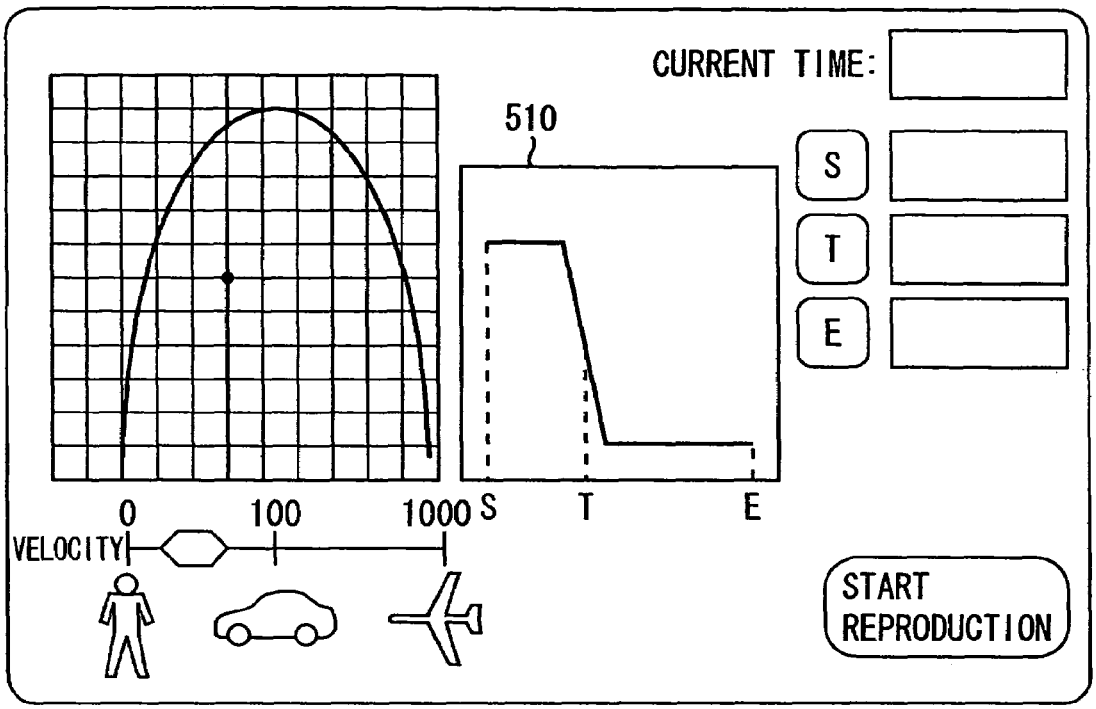
FIG. 5 is a schematic diagram illustrating an exemplary GUI screen that is presented on the display practiced as the variation.

Variation 2:

With reference to the above-mentioned embodiment, the realization of the sound image movement accompanying Doppler effect has been described. It is also practicable to display a graph (refer to FIG. 3) representative of the pitch variation of a tone due to the Doppler effect to which the listener listens. This variation is realized as follows. FIG. 4 is a block diagram illustrating an exemplary configuration of a sound image movement processing apparatus 40 according to this variation. The configuration of the sound image movement processing apparatus 40 shown in FIG. 4 differs from the configuration of the sound image movement processing apparatus shown in FIG. 1 only in the arrangement of a pitch curve generation block 150. This pitch curve generation block 150 computes frequency f of the tone to be listened to by the listener from equation (2) above on the basis of velocity Vs for each time received from the synchronous reproduction control block 130 and displays, in an area 510 of a GUI screen shown in FIG. 5, a graph (refer to FIG. 3) obtained by plotting the computed frequency f from the movement start time to the movement end time along the time axis. This variation allows the listener to visually understand the pitch variation of the tone, thereby letting the listener execute the editing in an intuitive manner.

Figure 6:
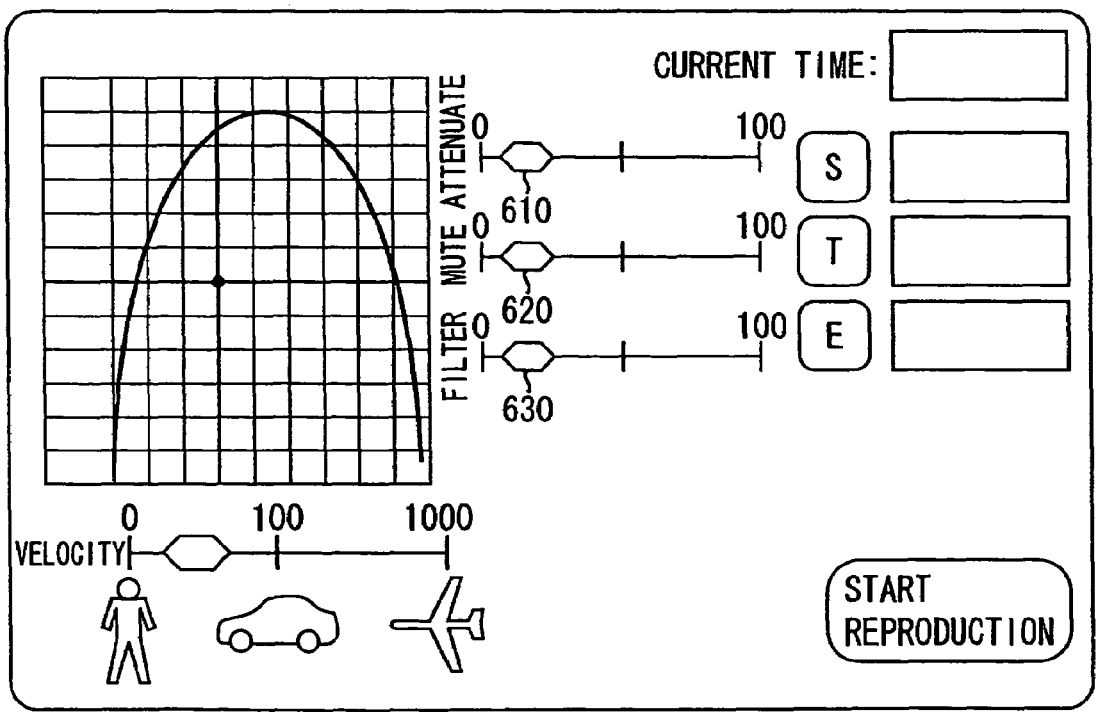
FIG. 6 is a schematic diagram illustrating an exemplary GUI screen that is presented on the display practiced as another variation.

Variation 3:

With reference to the above-mentioned embodiment, the setting of parameters such as moving point trajectory, moving velocity, movement start time, movement end time, and closest approach time is left to the user. It is also practicable to let the user set coefficients for adjusting the degrees of sound effects (for example, the attenuation in reverse proportion to the square of distance and the use of lowpass filter) in accordance with the distance between sound source and listener, in addition to the above-mentioned parameters. This variation is realized as follows. First, a GUI screen shown in FIG. 6 is displayed on the display block 110*a* in place of the GUI screen shown in FIG. 2. The GUI screen shown in FIG. 6 differs from the GUI screen shown in FIG. 2 in the arrangement of an indicator 610 for letting the user set the above-mentioned degree of the effect of attenuation in a range of 0 to 100%, an indicator 620 for letting the user set the degree of the effect of mute (for example, fade-in and fade-out duration) at the movement start time and the movement end time, and an indicator 630 for letting the user set the degree of the effect of the above-mentioned lowpass filter. Visually checking the GUI screen shown in FIG. 6, the user can set the coefficients indicative of the degrees of the above-mentioned sound effects by appropriately operating these indicators 610, 620, and 630 with the mouse of the user interface block 110. The coefficients thus set are passed from the user interface block 110 to the signal processing block 140, which executes the sound effects applied with these coefficients. Thus, in this variation, the degrees of sound effects can be adjusted in accordance with the distance between sound source and listener.

Variation 4:

With reference to the above-mentioned embodiment, the coordinates of the reflection point and the curvature of a parabola indicative of the trajectory of the moving point are used as the parameters for uniquely identifying this parabola. In addition to these parameters, an angle between the axis of the parabola and y axis may be set. Setting this angle enhances the degree of freedom in setting the above-mentioned trajectory. To be more specific, the above-mentioned trajectory of moving point can be set by the following procedure. In the initial state with a parabola ($y=ax^2$) shown in FIG. 7(*a*) displayed in the area 210, the parabola is rotated so that the axis thereof forms angle θ with y axis (refer to FIG. 7(*b*)). It should be noted that points (x', y') on the parabola shown in FIG. 7(*b*) are related with points (x, y) on the parabola shown in FIG. 7(*a*) as shown in equations (4) and (5) below.

$$x'=x\cos(\theta)-ax^2\sin(\theta) \quad (4)$$

$$y'=x\sin(\theta)+ax^2\cos(\theta) \quad (5)$$

Figure 7A:
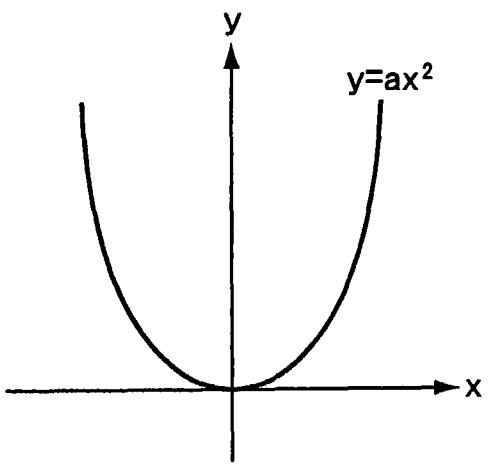
FIGS. 7(*a*), 7(*b*) and 7(*c*) are graphs for describing a trajectory setting procedure practiced as a further variation.
Figure 7B:
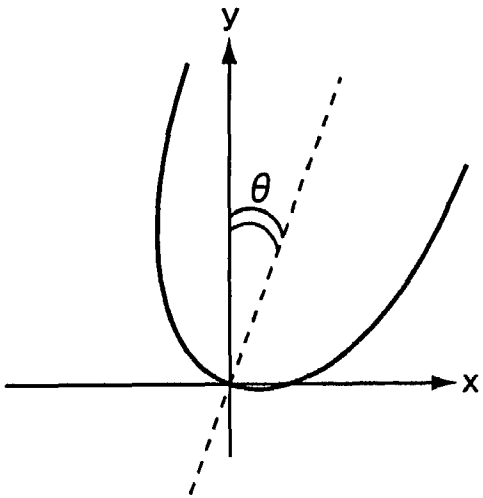
Figure 7C:
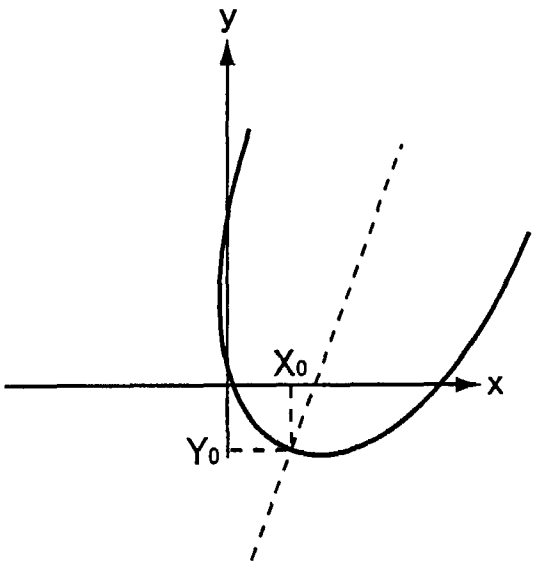

Next, the reflection points (0, 0) of the parabola shown in FIG. 7(*b*) are moved to (xo, yo) (refer to FIG. 7(*c*)). It should be noted that points (X, Y) on the parabola shown in FIG. 7(*c*) are related with points (x, y) on the parabola shown in FIG. 7(*a*) as shown in equations (6) and (7) below.

$$X=x\cos(\theta)-ax^2\sin(\theta)+xo \quad (6)$$

$$Y=x\sin(\theta)+ax^2\cos(\theta)+yo \quad (7)$$

In the above-mentioned embodiment, the curves or lines representative of the trajectory of sound source and the fixed point representative of the position of listener are set on the same plane. It is also practicable to set the curves or lines and the fixed point in a three-dimensional manner so that a plane containing the former does not contain the latter.

Variation 5:

In the above-mentioned embodiment, the sound image movement processing apparatus 10 is made up of the hardware modules each carrying out a unique function (the time code reception block 100, the user interface block 110, the position computation block 120, the synchronous reproduction control block 130, and the signal processing block 140). It is also practicable to make the control block based on the CPU (Central Processing Unit) execute programs for implementing the above-mentioned hardware modules, these programs being installed in a computer that is imparted with the same functions as those of the sound image movement processing apparatus 10. This variation allows the imparting of the same functions as those of the sound image movement processing apparatus according to the invention to general-purpose computers.

What is claimed is:

1. An apparatus for creating a sound image of an input sound signal in association with a moving point and a fixed point along a time axis, the sound image being associated with one of the moving point and the fixed point and the input sound signal being associated with the other one of the moving point and the fixed point, the apparatus comprising:

a setting section that sets input factors including a trajectory line which may be curved or straight and which represents a trajectory of the moving point, a nominal velocity of the moving point, a movement start time at which the moving point starts moving, a movement end time at which the moving point ends moving, and a closest approach time at which a distance between the moving point on the trajectory line and the fixed point is minimized;

a position computation section that computes a closest approach position which is a position of the moving point on the trajectory line at the closest approach time, a movement start position which is a position of the moving point on the trajectory line at the movement start time, and a movement end position which is a position of the moving point on the trajectory line at the movement end time, on the basis of the input factors set by the setting section, wherein the position computation section determines, as the movement end position, a position obtained by moving the moving point from the closest approach position along the trajectory at the nominal velocity in a predetermined direction by an amount of time corresponding to a difference between the movement end time and the closest approach time, and determines, as the movement start position, a position obtained by moving the moving point from the closest approach position along the trajectory at the nominal velocity in a direction reverse to the predetermined direction by an amount of time corresponding to a difference between the movement start time and the closest approach time;

a distance computation section that computes intermediate positions of the moving point along the trajectory line from the movement start position to the movement end position between the movement start time and the movement end time, and further computes a variable distance between each of the intermediate positions of the moving point and the fixed point;

a velocity computation section that computes a variable velocity of the moving point relative to the fixed point along the time axis on the basis of the variable distance computed by the distance computation section; and a signal processing section that attenuates or delays the input sound signal in accordance with the variable distance computed by the distance computation section and that varies a pitch of the input sound signal on the basis of the variable velocity computed by the velocity computation section, thereby creating the sound image of the input sound signal along the time axis.

2. The apparatus according to claim 1, wherein the signal processing section computes a variation of the pitch of the input sound signal which is generated from one of the moving point and the fixed point and which is received by the other one of the moving point and the fixed point, the apparatus further comprising a display section that displays the variation of the pitch of the input sound signal along the time axis.

3. The apparatus according to claim 1, wherein the setting section further sets an attenuation coefficient as one of the input factors, and the signal processing section determines an attenuation amount of the input sound signal in accordance with the variable distance, and further adjusts the attenuation amount in accordance with the attenuation coefficient.

4. A method of creating a sound image of an input sound signal in association with a moving point and a fixed point along a time axis, the sound image being associated with one of the moving point and the fixed point and the input sound signal being associated with the other one of the moving point and the fixed point, the method comprising the steps of:

setting input factors including a trajectory line which may be curved or straight and which represents a trajectory of the moving point, a nominal velocity of the moving point, a movement start time at which the moving point starts moving, a movement end time at which the moving point ends moving, and a closest approach time at which a distance between the moving point on the trajectory line and the fixed point is minimized;

computing a closest approach position which is a position of the moving point on the trajectory line at the closest approach time, a movement start position which is a position of the moving point on the trajectory line at the movement start time, and a movement end position which is a position of the moving point on the trajectory line at the movement end time, on the basis of the input factors;

computing intermediate positions of the moving point along the trajectory line from the movement start position to the movement end position between the movement start time and the movement end time, and further computing a variable distance between each of the intermediate positions of the moving point and the fixed point, wherein the movement end position is obtained by moving the moving point from the closest approach position along the trajectory at the nominal velocity in a predetermined direction by an amount of time corresponding to a difference between the movement end time and the closest approach time, and the movement start position is obtained by moving the moving point from the closest approach position along the trajectory at the nominal velocity in a direction reverse to the predetermined direction by an amount of time corresponding to a difference between the movement start time and the closest approach time;

computing a variable velocity of the moving point relative to the fixed point along the time axis on the basis of the variable distance; and processing the input sound signal such as to attenuate or delay the input sound signal in accordance with the variable distance and to vary a pitch of the input sound signal on the basis of the variable velocity, thereby creating the sound image of the input sound signal along the time axis.

* * * * *